US008297492B2

(12) United States Patent
Muyskens

(10) Patent No.: US 8,297,492 B2
(45) Date of Patent: Oct. 30, 2012

(54) CORNER REINFORCEMENT

(75) Inventor: David B Muyskens, Hendersonville, TN (US)

(73) Assignee: Sonoco Development, Inc., Hartsville, SC (US)

( * ) Notice: Subject to any disclaimer, the term of this patent is extended or adjusted under 35 U.S.C. 154(b) by 229 days.

(21) Appl. No.: 12/781,334

(22) Filed: May 17, 2010

(65) Prior Publication Data

US 2011/0278310 A1 Nov. 17, 2011

(51) Int. Cl.
*B65D 1/42* (2006.01)

(52) U.S. Cl. ..... 229/199; 220/646

(58) Field of Classification Search ..... 229/166; 220/646, 639; 217/52
See application file for complete search history.

(56) References Cited

U.S. PATENT DOCUMENTS

| | | | | |
|---|---|---|---|---|
| 2,476,197 | A * | 7/1949 | Kincaid | 206/586 |
| 2,509,468 | A * | 5/1950 | Anderson, Jr. | 206/586 |
| 3,220,683 | A * | 11/1965 | Doll | 248/345.1 |
| 4,292,901 | A | 10/1981 | Cox | |
| 4,366,905 | A | 1/1983 | Forshee | |
| 4,491,076 | A | 1/1985 | Firshee | |

FOREIGN PATENT DOCUMENTS

WO 2008/144102 A2 11/2008

* cited by examiner

*Primary Examiner* — Nathan J Newhouse
*Assistant Examiner* — Christopher Demeree
(74) *Attorney, Agent, or Firm* — Miller, Matthias & Hull LLP

(57) ABSTRACT

A corner reinforcement for distributing a load placed on top of a packaging unit is provided. The corner reinforcement comprises a top panel and two downwardly extending side panels and fits over the top end of a corner post to better distribute the load across the entire top end of the corner post and to reinforce the corner of the package to prevent the post and package from buckling, crushing or otherwise failing.

5 Claims, 4 Drawing Sheets

CORNER REINFORCEMENT

BACKGROUND OF THE INVENTION

1. Field of the Invention

This invention patent relates to a packaging system. More particularly, this invention relates to a means for reinforcing packaging corners that allows for some misalignment of vertically stacked packaging units without the bottom packaging unit collapsing or having a corner be crushed or fall inward.

2. Description of the Related Art

Articles such as outside air conditioners and large household appliances (washers, dryers, ranges, etc.) are often packaged and shipped in packaging units in which the article rests on a transport base and is enclosed by a box or carton, and in which vertical support posts are inserted between the article and the carton. The support posts are generally located adjacent the four interior corners of the carton (and thus are often referred to as corner posts) and typically extend from the transport base to the top of the carton. The posts not only protect the article from lateral impact forces but also provide axial (vertical) stacking strength. The forces applied to stacked packaging units can be substantial. For example, the force applied to the bottom unit in a stack of six 240 pound units is about 1200 pounds force. Loads placed on top of the packaging unit are borne primarily by the support posts and not by the packaged article.

When packaging units are not stacked in perfect vertical alignment (a phenomenon referred to as "off-stacking"), the corner posts bearing the brunt of the off-stacked load are more likely to fail (buckle) due to a less than optimal distribution of the load (stacking weight) on the corner post walls. At best, off-stacking can result in a slight crimping of the carton corner. At worst, off-stacking can result in the collapse of stacked units, damage to the packaged articles, and possible injury.

Thus it is an object of the present invention to provide a packaging system having reinforced corners that help spread the load to accommodate a certain amount of off-stacking.

Another object of the present invention is to provide a packaging system having reinforced corners that help prevent product damage and risk to personnel.

Still another object of the present invention is to provide a corner reinforcement that is made from a folded paper blank and has integrally formed strengthening ribs.

Further and additional objects will appear from the description, accompanying drawings, and appended claims.

Plastic corner post caps are known, but these caps are designed either to help secure smaller packaged articles in an cube type array, such as in U.S. Pat. No. 4,292,901; or to help register (vertically align) a unit stacked on top, such as in U.S. Pat. Nos. 4,366,905 and 4,491,076. In any event, unlike the present invention, none of these prior art corner posts caps are made from a folded paper blank or are designed to be used with a cardboard carton.

BRIEF SUMMARY OF THE INVENTION

The present invention is a corner reinforcement for a packaging unit to allow increased off-stacking. The packaging unit generally comprises a base upon which a packaged article rests, a cardboard box or carton enclosing the article, and corner posts inserted between the packaged article and the carton. The corner posts are located adjacent the four interior corners of the carton and extend from the base to the top of the carton. A corner reinforcement is placed on top of each corner post in order to better distribute any load placed on top of the unit, thereby preventing corner sagging or, worse, stack failures.

Each corner reinforcement comprises a top panel that covers the top end of the corner post and two side panels that extend downwardly from the top panel and are inserted between the packaged article and the carton.

Each corner reinforcement is made from a folded rectangular paper blank which comprises parallel opposing side edges and parallel top and bottom edges. Lateral fold lines divide the blank into two or more equal sections. Each section is further divided into a top half and a bottom half of substantially equal dimensions by a second lateral fold line. Each top half has further fold lines; preferably the bottom half does not.

Each top half comprises a triangular top panel and two substantially triangular side panels hingedly attached to the top panel along diagonal fold lines. The top panel is defined by a second lateral fold line and the two diagonal fold lines and is shaped like a right triangle.

To make the corner reinforcement the blank is folded in "rolling fashion" along the lateral fold lines to obtain a multi-layered rectangle having dimensions substantially equal to one of the halves. The rectangle is then folded downward at the two diagonal fold lines until each side panel is oriented at right angles to the top panel. The absence of fold lines, perforations, score lines or creases in the bottom halves causes the six-layered rectangle to slightly resist folding but results in a stronger, more effective corner reinforcement.

Glue or other adhesive may be applied to the blank before or during folding to join the various layers together. Ribs may be formed in the top panel to add strength to the corner reinforcement. Preferably the ribs run parallel to the machine direction of the paper.

DETAILED DESCRIPTION OF THE INVENTION

Figure 1:
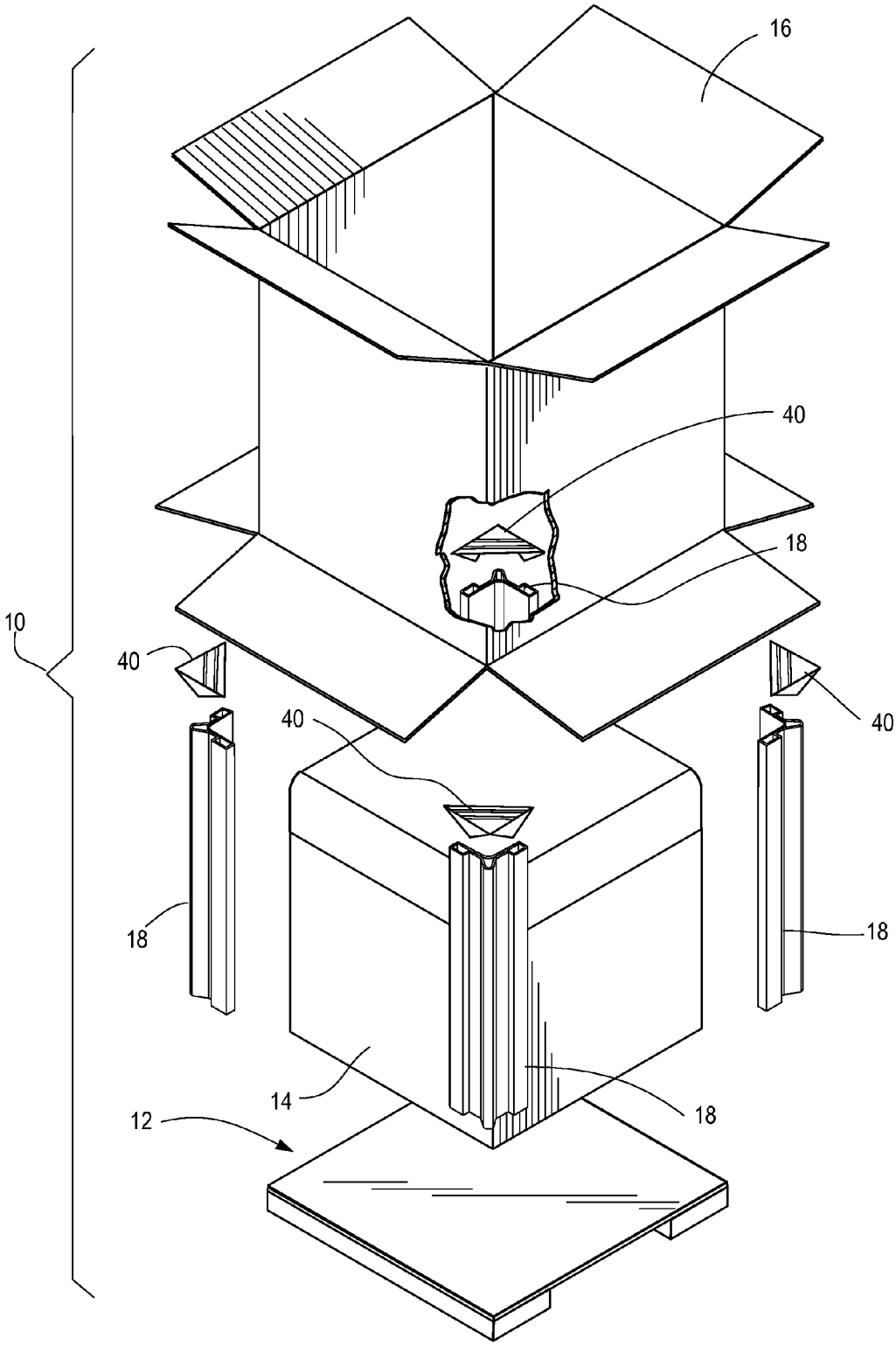
FIG. 1 is an exploded view of a packaging system, including corner reinforcements made according to the present invention.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

The Packaging Unit

Turning to the drawings, there is shown in FIG. 1 an exploded view of a packaging unit 10 incorporating the corner reinforcements 40 of the present invention. The packaging unit 10 generally comprises a base 12 upon which a packaged article 14 rests, a cardboard box or carton 16 enclosing the article 14 on four sides, and corner posts 18 inserted between the packaged article 14 and the carton 16. The corner posts 18 are located adjacent the four interior corners of the carton 16 and extend from the base 12 to the top of the carton 16. The corner posts 18 protect the article 14 from lateral impact forces and provide axial (vertical) stacking strength for the entire unit 10. Loads placed on top of the packaged article 10 primarily are borne by the corner posts 18. Other packaging elements can be included as part of the overall unit 10, including but not limited to lateral (horizontal) support posts and foam inserts. Plastic overwrapping may be used either in addition to the cardboard carton (to wrap the article) or as a substitute for the cardboard carton (as stretch wrap).

The article 14 to be packaged can be any large article, such as the air conditioning unit depicted in FIG. 1, a washer, dryer, dishwasher or other large household appliance. The article 14 typically rests on the transport base 12 during manufacture as it moves down an assembly line. The assembled unit 10 may be placed on a shipping pallet (not shown) to enable the unit 10 to be moved by fork lift truck or other means.

The Corner Posts

Figure 2:
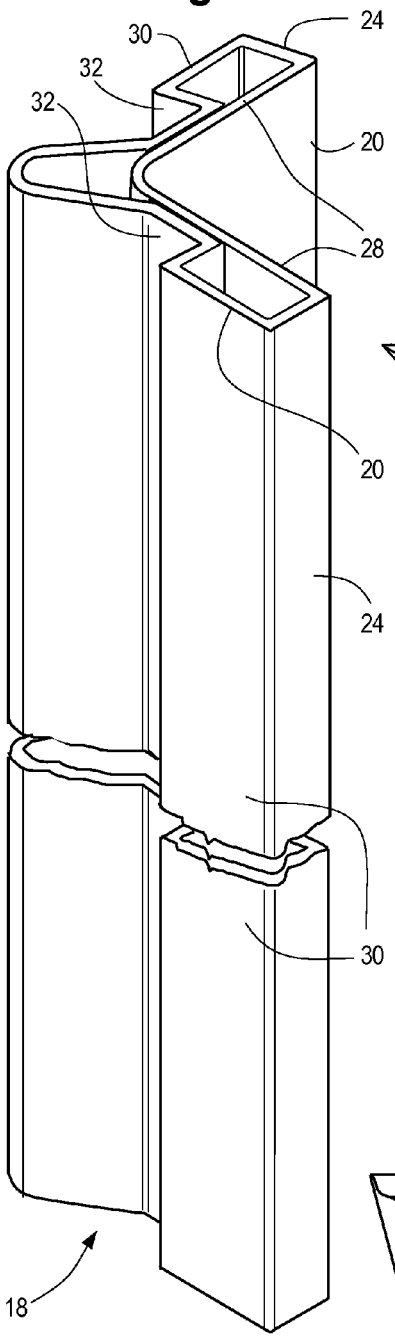
FIG. 2 is a perspective view of a conventional corner post.

FIG. 2 is a perspective view of one of the corner posts 18. Each corner post 18 may be made from a single sheet of paper or paperboard convolutely wound several times into a hollow tube having a circular cross-section and then reshaped into the modified L-shape shown in the figure (or any other desired shape). This L-shape enables the corner post 18 to fit snugly around the corners of the article 14 between the article 14 and the carton 14. The "L" shape also enhances structural strength both axially (vertically) and laterally (horizontally).

Each corner post 18 has a top end and a bottom end (that rests on the base 12) and comprises two legs 20 oriented substantially perpendicular to each other and terminating in rounded ends 24. The legs 20 are formed by an inner wall 28 (defined as the wall closest to the article 14) and an outer wall 30 (defined as the wall closest to the carton 16) in generally parallel spaced relation to each other to form a hollow core. Inwardly extending beads or grooves 32 may be formed in the outer wall 30 along each leg 20 at an area spaced from the rounded ends 24. The beads 32 extend the entire vertical length of the outer wall 30 and may contact the inner wall 28 along their apex. When installed, the corner posts 18 are wedged between the article 14 and the carton 16 with the outer wall 30 facing and abutting two perpendicular sides of the carton 16 and the inner wall 28 facing the article 14.

The Corner Reinforcements

In a key aspect of the invention, folded paper corner reinforcements 40 are placed over the top ends of the corner posts 18 to help spread any loads placed on top of the unit 10 across the entire top surface of the corner posts 18, thereby helping to prevent the posts 18 and/or packaging unit 10 from buckling, crushing or otherwise failing, even when stacked units 10 are misaligned (off-stacked).

Figure 3:
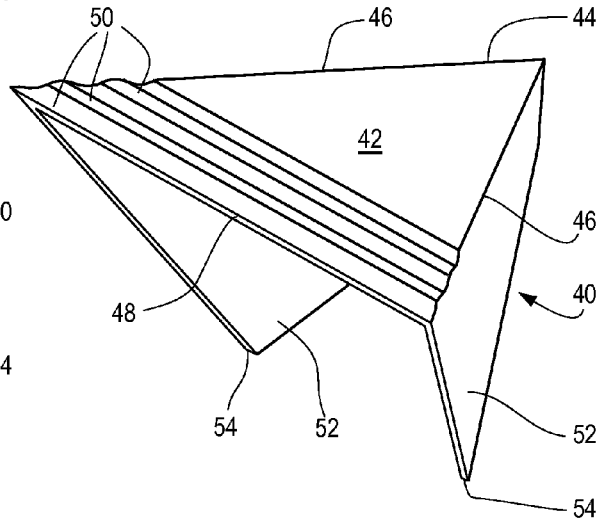
FIG. 3 is a perspective top view of a corner reinforcement made according to the present invention.
Figure 4:
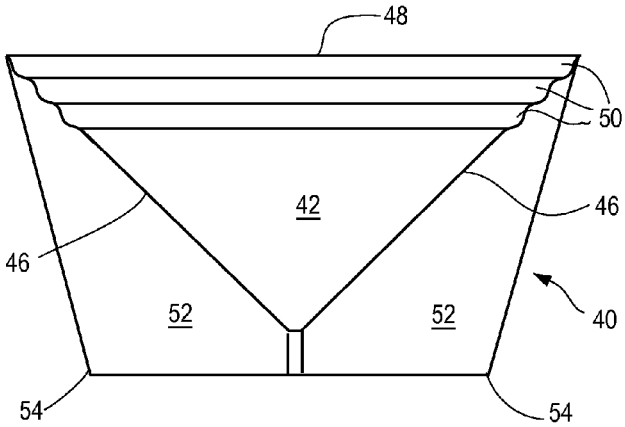
FIG. 4 is a perspective bottom view of the corner reinforcement of FIG. 3.

FIGS. 3 and 4 are top and bottom perspective views respectively of a corner reinforcement 40 according to the invention. Each corner reinforcement 40 is made from a folded paper blank 60 described in more detail below, and comprises a substantially flat, triangular, load bearing, top panel 42 large enough to cover at least the top end of a corner post 14. The periphery or outer edge 44 of the top panel 42 defines a right triangle, and more preferably an isosceles right triangle having two orthogonal side edges 46 of equal length and a front or diagonal edge 48 that forms the hypotenuse of the right triangle.

Preferably one or more ribs 50 are formed in the top panel 42 parallel to the front edge 48. Preferably the rib 50 located farthest from the front edge 48 impinges on (abuts) the corner post 18 and, more specifically, the rounded ends 24 of the corner post legs 20, to help position and stabilize the corner reinforcement 40 so that it does not move with respect to the corner post 18.

Each corner reinforcement 40 further comprises a two side panels 52 hingedly or foldably connected to the top panel 42 along the side edges 46 and extending downward therefrom at substantially right angles to the top panel 42. Each side panel 52 is substantially triangular and terminates in an apex 54.

The Blank

Figure 5:
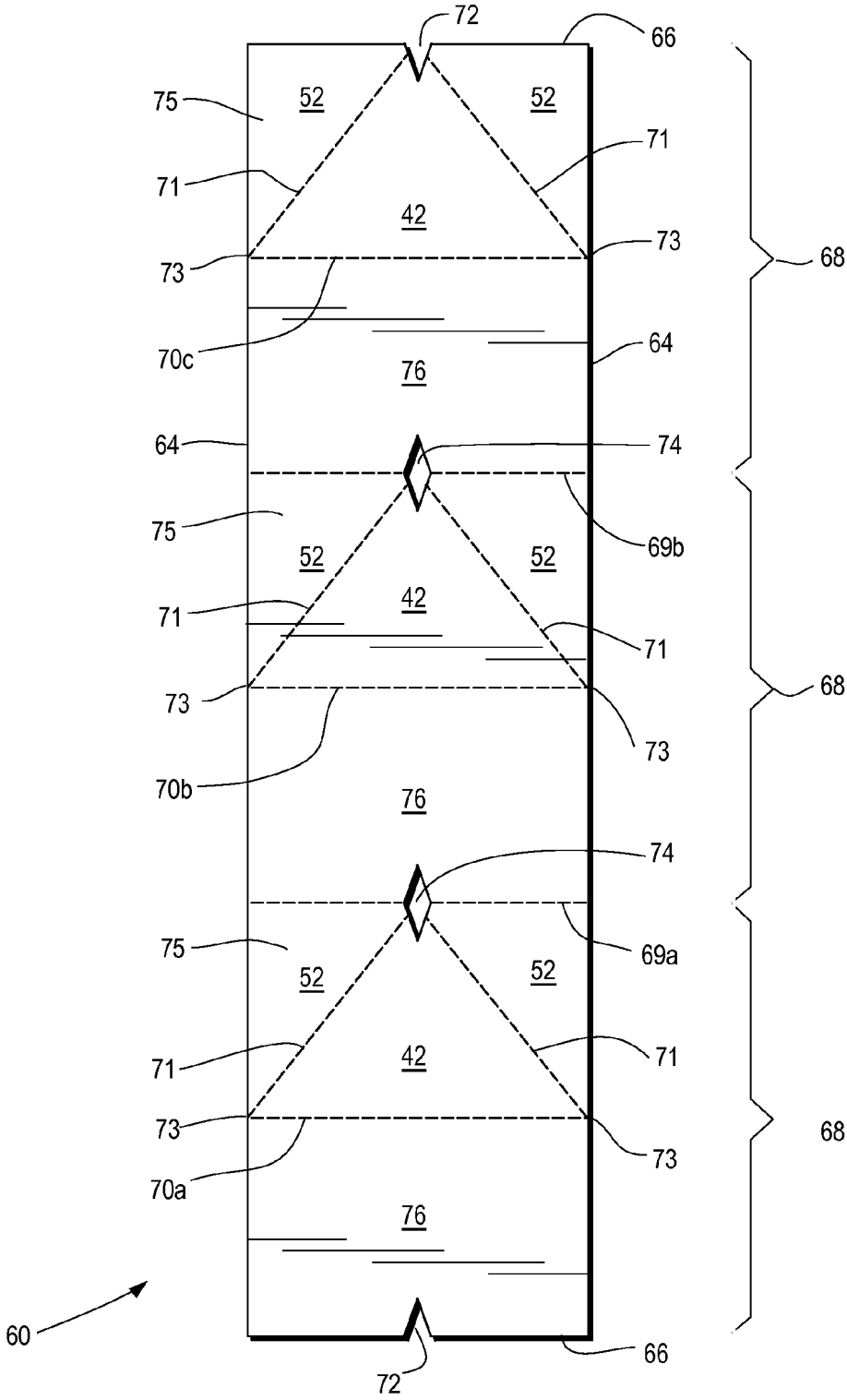
FIG. 5 is a top plan view of a blank used to make the corner reinforcement of FIG. 3.

The corner reinforcement 40 is made from a rectangular blank 60 such as the one shown in FIG. 5. As viewed in FIG. 5, the blank 60 has parallel opposing side edges 64 and top and bottom edges 66, and is divided into three equal sections, or thirds 68, by two parallel lateral fold lines 69. Each section 68 is further divided by a second lateral fold line 70 into a top half 75 and a bottom half 76 of equal dimensions. Each top half 75 has further fold lines as described below; preferably the bottom half 76 does not.

Substantially triangular notches 72 are formed along the top and bottom edges 66 of the blank 60 equidistant from the side edges 64, and diamond shaped notches 74 are formed along the first lateral fold lines 69 equidistant from the side edges 64 to facilitate folding the blank 60 into a corner reinforcement 40 as explained further below.

Each top half 75 comprises a triangular top panel 42 and two side panels 52 separated by diagonal fold lines 71. The diagonal fold lines 71 run (extend) from the triangular notch 72 or from the diamond shaped notch 74 to the ends 73 of the second fold lines 70 and are substantially perpendicular to each other.

Thus each top half 75 comprises a top panel 42 and two side panels 52. The top panel 42 is shaped like a right triangle and is defined by a second lateral fold line 70 and two diagonal fold lines 71. Each side panel 52 is hingedly attached to the top panel 42 along a diagonal fold line 71.

Each bottom half 76 is foldably connected to a top half 75 and, more specifically, to a top panel 42 along a second lateral fold line 70. As explained in the next section the bottom halves 76 preferably do not have fold lines, perforations or score lines, which provides for a stronger corner reinforcement 40.

The blank 60 does not include the integrally formed ribs 50; these are formed later.

Making the Corner Reinforcement

To make a corner reinforcement 40, the blank 60 is folded in "rolling fashion" (not "accordion fashion") along the first and second fold lines, 69, 70. For example, with reference to FIG. 5, the bottommost half 76 of the blank 60 is folded under at the second lateral fold line **70*a* and then folded under again at the first lateral fold line 69*a*, continuing in this manner until the blank 60 is folded into a six layered rectangle one sixth the size of the original blank 60**.

The six layered rectangle comprises a top panel 42 and two side panels 52 separated by two diagonal fold lines 71. The rectangle is then folded downward at the two diagonal fold lines 71 until each side panel 52 is oriented at right angles to the top panel 42 with its apex 54 pointing downward as shown in FIG. 3. The absence of fold lines, perforations, score lines or creases in the bottom halves 76 causes the six-layered rectangle to slightly resist folding but results in a stronger, more effective corner reinforcement 40.

Glue or other adhesive may be applied to the blank before or during folding to join the various layers together. Although a six-layer corner reinforcement 40 is shown in the figures, the corner reinforcement can be made with fewer or more layers by changing the number of sections 68 in the blank 60.

The ribs 50 may be formed in the top panel 42 in any suitable manner, such as by clamping or pressing, to add strength to the corner reinforcement 40. Preferably the ribs 50 run parallel to the machine direction of the paper. (The machine direction is the direction in which the greater number of sheet fibers tend to be oriented as a result of the forward motion of the papermaking machine wire.)

Assembling the Package and Using the Corner Reinforcements

Figure 6:
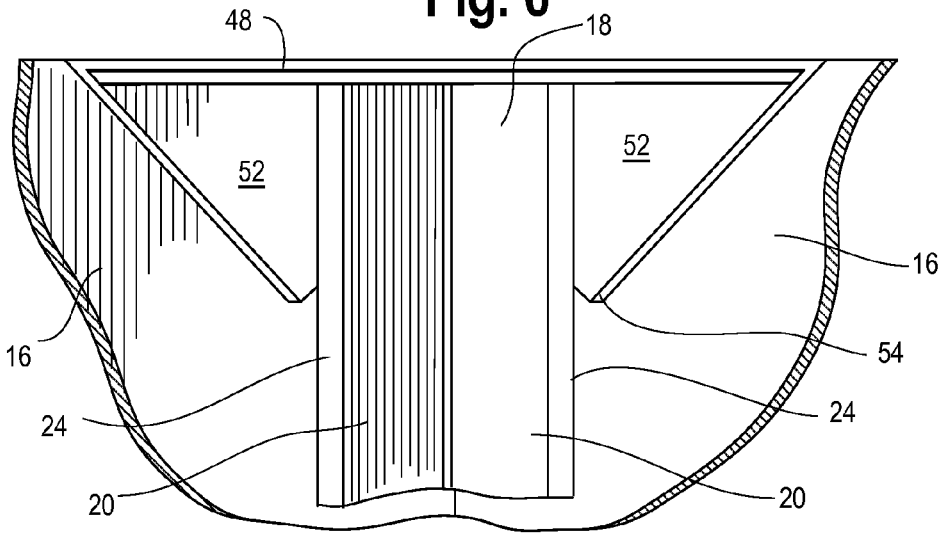
FIG. 6 is a front plan view of a corner reinforcement made according to the present invention shown installed.
Figure 7:
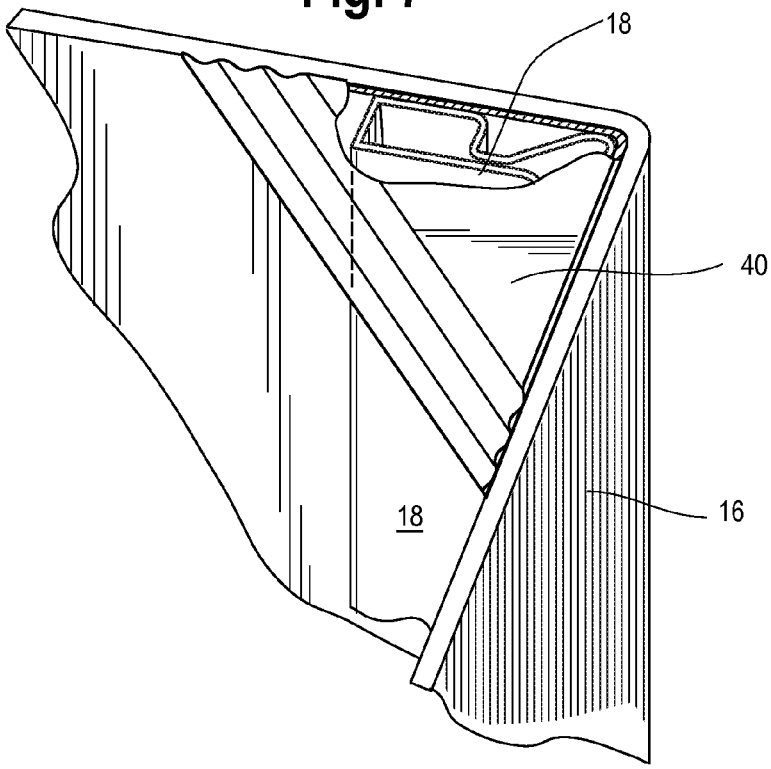
FIG. 7 is a perspective and partial cutaway view of a corner reinforcement made according to the present invention shown installed.

The packaging unit 10 shown in FIG. 1 may be assembled in the following manner. First, the article 14 is placed on the base 12, typically as the article 14 moves along a manufacturing assembly line. Once the article itself is fully assembled and ready for shipping, the carton 16 is placed over the article 14 and the base 12. The corner posts 18 are then inserted adjacent the inside corners of the carton 16 between the carton 16 and the article 14. A corner reinforcement 40 may then be placed over each corner post 18 with each side panel 52 inserted or wedged between the article 14 and a side of the carton 16 as shown in FIGS. 6 and 7. The top panel 42 should rest on and cover the top end of the corner post 18. The pointed triangular shape of the side panels 52 helps guide the corner reinforcement into place.

When the corner reinforcement 40 is installed and the carton 16 closed, the top panel 42 of each corner reinforcement 40 should be flush with the top of the carton 16 so that any load placed on top of the unit 10 will be transmitted through the corner reinforcements 40 to the corner posts 18.

Thus there has been described a packaging unit 10 that can be stored and moved in stacked arrays. In a key aspect of the invention corner reinforcements 40 are placed on top of the corner posts 18 to distribute the load from units 10 stacked on top over the entire end wall surface of the corner posts 18 to prevent the posts 18 from buckling and the corners of the packaged units from falling inward. The corner reinforcements 40 help protect the unit 10 from failure even when units are off-stacked by spreading the load in corners of the package that are not normally supported.

It is expected that the corner reinforcements could fit on the outside of the carton. It is also expected that the corner reinforcements could be pre-attached to the carton or could be attached to an insert to allow for all four corner reinforcements to be installed at the same time. Finally, it is expected that the corner reinforcements could be fitted onto the bottom ends of the corner posts.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

I claim as my invention:

1. A corner reinforcement for distributing a load stacked on top of a packaging unit, the corner reinforcement made from a folded rectangular paper blank, the blank comprising:

parallel opposing side edges;

parallel top and bottom edges; and one or more first lateral fold lines parallel to the top and bottom edges, the first lateral fold lines dividing the blank into two or more equal sections;

wherein each section is divided into a rectangular top half and a rectangular bottom half of substantially equal dimensions by a second lateral fold line parallel to the top and bottom edges, the second lateral fold line having opposing ends;

wherein each top half comprises a triangular top panel and two substantially triangular side panels, each triangular top panel being defined by one of the second lateral fold lines and two diagonal fold lines, each diagonal fold line extending substantially from a point along one of the first lateral fold lines equidistant the side edges to an opposing end of one of the second fold lines, each of the triangular side panels being hingedly attached to the triangular top panel along one of the two diagonal fold lines; and wherein the bottom half of each section is free of fold lines, perforations or score lines.

2. The corner reinforcement of claim 1 wherein the side panels are folded downward at right angles to the triangular top panel.

3. The corner reinforcement of claim 2 wherein the paper blank has a machine direction and wherein the corner reinforcement further comprises one or more integrally formed ribs running parallel to the machine direction.

4. The corner reinforcement of claim 3 wherein the blank further comprises:

first notches formed along the top and bottom edges equidistant from the side edges; and a second notch formed along each of the one or more first fold lines equidistant from the side edges;

wherein each diagonal fold line extends from a notch to an end of the second lateral fold line.

5. A corner reinforcement for distributing a load stacked on top of a packaging unit, the corner reinforcement made from a folded rectangular paper blank having a machine direction, the blank comprising:

parallel opposing side edges;

parallel top and bottom edges; and one or more first lateral fold lines parallel to the top and bottom edges, the first lateral fold lines dividing the blank into two or more equal sections;

wherein each section is divided into a rectangular top half and a rectangular bottom half of substantially equal dimensions by a second lateral fold line parallel to the top and bottom edges, the second lateral fold line having opposing ends;

wherein each top half comprises a triangular top panel and two substantially triangular side panels, each triangular top panel being defined by one of the second lateral fold lines and two diagonal fold lines, each diagonal fold line extending substantially from a point along one of the first lateral fold lines equidistant the side edges to an opposing end of one of the second fold lines, each of the triangular side panels being hingedly attached to the triangular top panel along one of the two diagonal fold lines;

wherein the side panels are folded downward at right angles to the triangular top panel; and wherein the corner reinforcement further comprises one or more integrally formed ribs only in the to panel, said ribs running parallel to the machine direction.

* * * * *